United States Patent [19]

Ganshaw

[11] 4,397,636

[45] Aug. 9, 1983

[54] BODY SURFING SHIRT

[76] Inventor: Samuel H. Ganshaw, Box 81E, Lupton Point, Mattituck, N.Y. 11952

[21] Appl. No.: 233,259

[22] Filed: Feb. 10, 1981

[51] Int. Cl.[3] ..... A63B 31/00

[52] U.S. Cl. ..... 441/65; 441/117; 2/2

[58] Field of Search ..... 2/2 R, 2.1 R, 16, 17; 9/307, 311, 329, 338, 337, 340, 341-344, 347, 348; 441/102, 106, 65, 107, 117

[56] References Cited

U.S. PATENT DOCUMENTS

| | | | |
|---|---|---|---|
| 252,828 | 1/1882 | Williams | 9/341 |
| 1,005,569 | 10/1911 | DeMeir | 9/343 |
| 1,162,214 | 11/1915 | Boddy et al. | 9/341 |
| 2,425,206 | 8/1947 | Ripley | 9/20 |
| 2,775,776 | 1/1957 | Shaw | 9/20 |
| 2,807,035 | 9/1957 | Phillips | 9/342 |
| 3,019,459 | 2/1962 | Ripley | 9/342 |
| 3,073,728 | 11/1962 | Saunders et al. | 2/16 |
| 3,266,069 | 8/1966 | O'Link | 9/341 |
| 3,550,159 | 12/1970 | Alarco | 2/2 |
| 3,747,141 | 7/1973 | Crockford | 9/341 |
| 3,803,652 | 4/1974 | Uyehara | 441/66 |
| 3,945,042 | 3/1976 | Lobo | 2/2 |
| 4,011,596 | 3/1977 | Chang | 2/16 |

*Primary Examiner*—Trygve M. Blix
*Assistant Examiner*—Thomas J. Brahan
*Attorney, Agent, or Firm*—Sughrue, Mion, Zinn, Macpeak and Seas

[57] ABSTRACT

A shirt formed of a woven material which clings when wet and having long sleeves, elastic cuffs, collar and waist band, bears underlying forearm pads on respective sleeves between the elbow and the cuff, and a chest pad is centered on the front of the shirt body. The pads being buoyant and fitted to the shirt provide an extra degree of body lift, flotation, while increasing speed and distance for the body surfer during wave riding.

2 Claims, 4 Drawing Figures

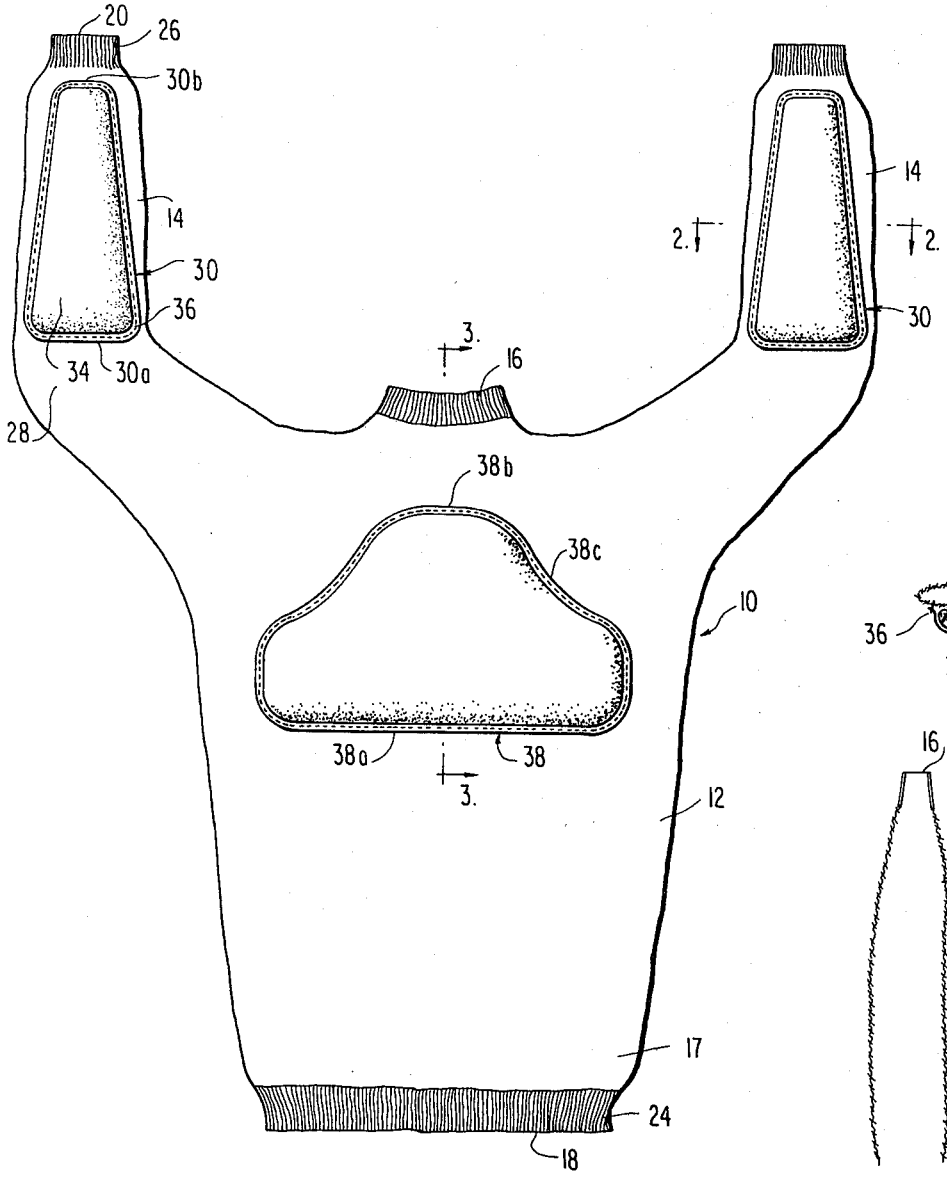
FIG. 1
FIG. 2
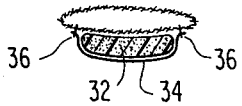
FIG. 3
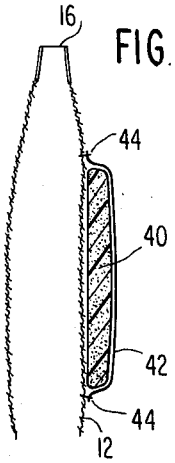
FIG. 4
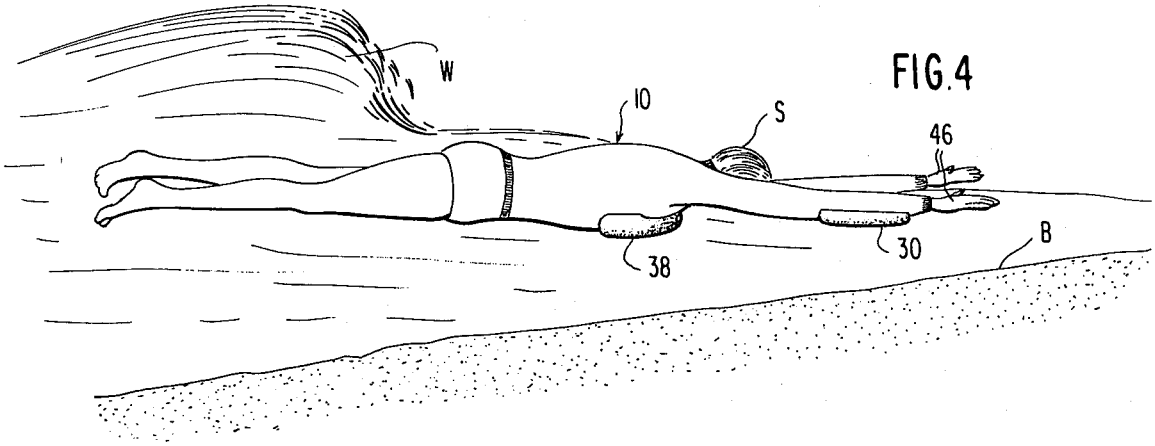

BODY SURFING SHIRT

BACKGROUND OF THE INVENTION

This invention relates to body surfing, and more particularly, to a body surfing shirt for protecting the body surfer and providing improved lift and flotation without impeding free swimming.

The sport of surf riding or surfing may be carried out through the use of a surf board upon which the surfer crouches with the board providing the buoyancy necessary to support the surfer and functioning as a wave propelled marine craft. Alternatively an inflatable raft capable of supporting the body of the surfer who lies face downward on the raft may be employed, with the wave again propelling the raft and its occupant in a generally horizontal fashion from the point where the wave breaks to the beach. For years, body surfing has also been enjoyed by swimmers and the like who simply extend their bodies horizontally, project their arms forwardly and in line with their body while allowing the breaking wave to drive them shoreward with the surf until contact is made with the beach. Body surfing is a sport enjoyed by bathers whenever the waves are large enough to propel one's body with the surf. Physically, one wades into the water until the water is chest deep and then awaits a proper wave (normally a larger wave than usual). Just before the wave breaks, the body surfer springs from the bottom, lies horizontally in the water and places his arms outstretched and towards the shore. When engulfed in the force of the breaking wave, the body surfer enjoys a thrilling horizontal ride onto the beach. Where the surf is relatively large, resulting from a seasonal storm or the like, the force exerted by the surf can be tremendous. Many body surfers experience being forceably driven onto the beach, resulting in severe abrasions about the shoulders, arms and even the face. Under some circumstances, depending upon wave activity and beach or shore characteristics, the body surfer can be thrown upside down particularly where the surf tends to drive the surfer forwardly and downwardly instead of horizontally with the surf onto the beach.

It is, therefore, an object of the present invention to provide a surf shirt which may be worn by a swimmer, when body surfing, to enhance body surfing by providing an extra degree of lift and flotation and to thereby increase the speed and distance traveled during body surfing.

It is a further object of the present invention to provide a surf shirt for a swimmer when body surfing which does not materially interfere with free swimming which provides flotation and at the same time protection to the body surfer's arms and upper body from ocean bottom scrapes cuts, cold water hypothermia, jellyfish and sea nettle stings and the like.

SUMMARY OF THE INVENTION

The invention is directed to a body surfing shirt comprising a long sleeve garment formed of a cloth which tends to cling to the body of the surfer when wet, the garment having wrist cuffs at the ends of the sleeves, a crew collar and a waist band. The cuffs, collar and waistband are elastic to tightly grip the surfer. A buoyant forearm pad carried on each sleeve along the underside thereof at the sleeve forearm, and a buoyant chest pad is carried by the garment on the frontal chest portion thereof. This provides an extra degree of lift and flotation to the body surfer and increases the speed and distance of body surfing while protecting the arms and upper body from ocean bottom scrapes and cuts, cold water hypothermia and jellyfish and sea nettle stings, without materially affecting the ability of the wearer in free swimming.

Preferably, the forearm pads are of a length generally equal to the distance from the cuffs to the elbows of the sleeves, and the chest pad is of a modified triangular plan form with the apex end facing towards the collar and being spaced therefrom to allow free movement of the body surfer's arms to overhead position, while springing with an on-coming wave to horizontal surfing position.

BRIEF DESCRIPTION OF THE DRAWINGS

FIG. 1 is a front elevational view of a body surfing shirt in accordance with a preferred embodiment of the present invention.

FIG. 2 is a sectional view of one sleeve of the body surfing shirt of FIG. 1 taken about line 2—2.

FIG. 3 is a sectional view of a portion of the surfing shirt body taken about line 3—3 of FIG. 1.

FIG. 4 is a perspective view of a body surfer wearing the shirt illustrated in FIGS. 1 through 3 inclusive and showing the nature of the extra degree of lift and flotation provided to the body surfer when wearing the shirt of the present invention while providing physical protection against ocean bottom scrapes and cuts when approaching the beach.

DESCRIPTION OF THE PREFERRED EMBODIMENT

The present invention is directed to a body surfing shirt, indicated generally at 10, in the form of a long sleeved shirt or sweater like garment, including a body 12 bearing sleeves 14 to each side thereof. The body 12 terminates at neck 15 with a neck opening 16, defined by an elastic collar 22. At its lower end, body 12 terminates in a waist portion as at 17 which opens as at 18. An elastic or stretch material waist band 24 corresponding in its nature and function to the elastic collar 22 is provided to body 12. The collar 22 and the waist band 24 may be integrally formed or may be separately formed. However, their function is to closely grip the body of the surfer at the neck and waist thereof. In similar fashion, each of the sleeve 14 terminate in elastic cuffs as at 26 defining wrist openings 20. The garment may be formed of a woven material such as cotton, Dacron or the like, and one, which when wet, tends to cling to the body of the surfer and thus does not impede in free swimming or body surfing.

Important to the present invention and constituting a principal element of the body surfing shirt is the employment of dual purpose pads comprising two forearm pads at 30 and a singular chest pad indicated generally at 38. The placement of the pads and their size and configuration facilitate the provision of an extra degree of lift and flotation to the body of the surfer relative to the breaking waves and surf to maximize the speed and distance covered by the surfer during body surfing. Thus, in addition to providing flotation, the pads, which are formed of a suitable flotation material such as a closed foam material, function to provide to the body surfers the correct attitude tending to raise slightly the chest and forearms and arms of the body surfer when in use, as evidenced in FIG. 4. The forearm pads 30 are comprised of a PVC foam pad member 32 or the like which may be of one inch thickness foam material in a modified parallelepiped, FIG. 8, that is with a slight taper from elbow 28 to the elastic cuff 26. Base portion 30*a* of the pad, at the sleeve elbow, is wider than its opposite end 30*b*. Typically, the pad 30 may be eight inches in length, may be three and one-half inches wide at the base or end 30*a* and one and one-half inches at end 30*b* adjacent the elastic cuff 26.

A strip or cover 34 of suitable synthetic fabric covers the foam pad 32 and may be sewn about its edges as indicated at 36 to the material forming the garment proper. Obviously, the pad member 32 may be fixed in another manner. If the shirt is formed of two layers of material, it may be sandwiched between the layers, sewn in place. Further, instead of thread stitching as indicated at 36, the strip 34 may be heat welded about its edges to the sleeve material if the material making up the strip 34 and the garment proper is capable of thermo-welding.

A chest pad 38 is provided on the front of the garment. Chest pad 38 covers a limited area of the body 12 of the garment. The chest pad 38 as indicated is of modified triangular form with rounded corners and with a base portion 38*a* which is much wider than upper portion 38*b* and is spaced some distance from the elastic collar 22. This provides an indented area 38*c* to each side of the chest pad 38, the function of which is to allow the movement of the arms of the surfer to overhead position while springing with the wave to the body horizontal position, as shown in FIG. 4, during the act of initiating body surfing action. In the manner of the forearm pads 30, the chest pad 38 is formed of a PVC foam material or other buoyant material pad member 40. In the illustrated embodiment it is one inch in thickness, and in terms of dimensions, is approximately twelve inches wide at its base portion 38*a*, is approximately seven inches in height and the indented area 38*c* being located approximately four inches above the base line or base portion 38*a*. The lateral width in the area of the indentations is approximately one-half that adjacent of base portion 38*a*. The pad member 40 is maintained on the front of body shirt 12 at chest height by a panel 42 whose edges are sewn at 44 in the manner of the forearm pad or cover strip 34.

In the illustrated embodiment, the upper edge 38*b* of the chest pad is located approximately three inches below the elastic collar 22. As may be appreciated, the garment includes front and back portions as seen in FIGS. 2 and 3, which may be edge sewn together to form the garment.

The surfer S dons the garment by pulling it over his head, similar to a sweater or other tight fitting shirt. The elastic collar encircles the neck of the surfer S while the waist band closely fits to the body of the surfer, about his waist. The positions of the chest pad 38 and the forearm pads 30 may be easily seen and the effect in use appreciated by reference to FIG. 4. The hands of the surfer 46 protrude from the cuffs 26. The pads 30 and 38 adequately functioning to prevent ocean body scrapes and cuts when the surfer S is thrown rapidly forwardly towards and onto the beach B by an oncoming wave W creating the surf. The surfer is shown subsequent to his springing from an upright position to the horizontal position in advance of the wave W which propels him rapidly towards the beach B.

By the use of the buoyant pads under the forearms and across the chest area of the body surfing shift, the wearer gets a tremendous lift effect while being propelled to the shore by the breaking wave W. The extra degree of lift and flotation results in improved speed and distance for the body surfer.

As may be appreciated, the body surfing shirt may be made of many different types of materials, such as cotton, Dacron or any of the synthetic fibers or combinations thereof. Due to the inclusion of the flotation pads 30 and 38, should the surfer be swept under due to the undertow, these pads increase the chances of the surfer to survive, therefore providing a safety effect to the novel body surfing shift of the instant invention.

While the invention has been particularly shown and described with reference to a preferred embodiment thereof, it will be understood by those skilled in the art that various changes in form and details may be made therein without departing from the spirit and scope of the invention.

What is claimed is:

1. A body surfing shirt comprising a garment formed of a cloth tending to cling to the body of the wearer when wet, said garment including a garment body with long sleeves extending therefrom, said sleeves terminating in wrist cuffs, a crew collar at the top of the garment body and a waist band at the bottom of said garment body, with said cuffs, collar and waist band being elastic so as to tightly grip the body of the wearer, buoyant forearm pads carried on the underside of the forearms of said sleeves and a buoyant chest pad carried by said garment body at chest height and on the frontal portion thereof, said garment being devoid of buoyant pads other than said forearm pads and said chest pad, such that said forearm pad and said chest pad provide an extra degree of lift and flotation to increase the speed and distance covered by the wearer when body surfing, ensuring a horizontal body position to overcome the tendency for the surf to drive the surfer forwardly and downwardly, without impairment to the wearer's body movement during body surfing and at the same time without materially interfering with the body surfer's free swimming ability and while particularly protecting the body surfer's arms and upper body chest area from ocean bottom scrapes and cuts upon contact with the beach during body surfing.

2. The body surfing shirt as claimed in claim 1, wherein said forearm pads are of modified parallelepiped form and extending longitudinally of the sleeve from said elastic cuff to the elbow of said sleeve, and having a width at said elbow in excess of that at said elastic cuff, and wherein said chest pad is of modified triangular form with an apex end towards the collar and being spaced therefrom to allow free movement of the wearer's arms to overhead position when springing with the wave to generally horizontal position.

* * * * *